United States Patent [19]

Hendrix

[11] Patent Number: 5,040,919

[45] Date of Patent: Aug. 20, 1991

[54] DEVICE FOR CONTROLLING FLOOD WATERS AND/OR HAZARDOUS LIQUID SPILLS

[76] Inventor: Glen Hendrix, 1726 Sky Lark Ln., Houston, Tex. 77056

[21] Appl. No.: 522,308

[22] Filed: May 11, 1990

[51] Int. Cl.[5] ..... E02B 7/20

[52] U.S. Cl. ..... 405/415; 405/91

[58] Field of Search ..... 405/107, 115, 108, 110, 405/111, 112, 113, 114, 116, 91

[56] References Cited

U.S. PATENT DOCUMENTS

| | | | |
|---|---|---|---|
| 3,213,628 | 10/1965 | Serota | 405/114 X |
| 4,136,995 | 1/1979 | Fish | 405/115 |
| 4,362,433 | 12/1982 | Wagner | 405/107 |
| 4,650,360 | 3/1987 | Bayer | 405/111 |
| 4,692,060 | 9/1987 | Jackson | 405/115 |
| 4,799,821 | 1/1989 | Brodersen | 405/115 |
| 4,921,373 | 5/1990 | Coffey | 405/115 |

FOREIGN PATENT DOCUMENTS

| | | | |
|---|---|---|---|
| 111515 | 8/1980 | Japan | 405/115 |
| 40406 | 3/1985 | Japan | 405/115 |
| 264202 | 11/1987 | Japan | 405/115 |

*Primary Examiner*—Dennis L. Taylor
*Assistant Examiner*—Arlen L. Olsen

[57] ABSTRACT

A containment structure for controlling flood water or spilled liquids comprising an elongated, triangular flexible container to be placed where needed to form a stable, water-tight barrier. The containment structure has a spout for introduction of water into the container, a front flap for anchoring the container, and has end pieces adapted to be used for sealing the end of the container against irregular objects or another container. A floating pump assembly can be provided for filling the container with flood waters.

8 Claims, 3 Drawing Sheets

DEVICE FOR CONTROLLING FLOOD WATERS AND/OR HAZARDOUS LIQUID SPILLS

BACKGROUND

1. Field of Invention

This invention relates generally to flood control or hazardous liquid containment and specifically to a device to accomplish said control or containment.

2. Description of Prior Art

Whenever minor flooding occurs, it normally follows patterns of previous flooding. People respond to this with walls of sand bags placed in strategic places to divert or hold back flood water. In the case of hazardous liquid spills, special units of the fire department must depend on local material to fill sand bags wherever a spill occurs.

In either case, filled sand bags must be stored or sand kept handy for the filling of the bags or a suitable material must be found on site for the filling of the bags. Once the bags are filled, they must be transported from the fill site to where they will be used. This entails much labor involving stooping and bending increasing the risk of back injuries. This process is also slow, depending on how many people are available for the task. Heretofore, some solutions to this problem have been suggested.

One such device is a water-filled tube shaped like an equilateral triangle with an elaborate system of outside supporting members every foot or so to maintain its shape. The problem is the solid support members take up space and have weight that has to be transported. Also, there is labor involved setting up these supports and fastening them in place with an equal amount of labor involved in taking the device down.

The same problem exists for another device where the dam is simply a sheet of flexible film, making the attendant bracing necessarily heavier for support and stability.

Another way of addressing the problem is to replace the sand bag with another type of bag as in Bayer's device (4,650,368) wherein a water permeable bag of porous, absorbent material is used in place of sand bags. Being lighter than sand bags, they are easier to place, but no mention is made of drying, storage or disposal after they have absorbed water and done their job. Also, their permeability assures some leakage.

Another device is a bag to be filled with water instead of sand. Fitted with valves, cleats, special shapes and coverings, this device would be heavier than sand bags (more labor, more injury risk) while being much more expensive.

Brodersen's device (4,799,821) is more practical than the above but still leaves much to be desired. It consists of a plastic tube that assumes an oval shape when filled with water. It is tied in a knot at each end to keep water in. For one thing, it would seem to be difficult to introduce water into the device through an open end. The end would have to be elevated somehow, requiring one person to hold it while another introduces water into the opening. Also, tying a knot in a 7" diameter tube of 10 mil thick plastic may not be an effective way of sealing such a device. It would depend on the person's strength as to whether the device leaked or not. Also, the geometry of the filled tube is such that water would seep under it easier than under a triangular shape, necessitating some sort of sealing compound, as is pointed out, to be used to prevent leakage. This oval shape causes flood waters to exert minimal downward force compared to lateral forces, creating an instability in location of the device during service. Therefore, this device would work better if a heavier fluid than that it is to contain or divert is used to fill it. Once filled, the knot in each end makes it difficult to seal the ends against themselves or other objects. The invention described herein will obviate the described disadvantages of previous solutions and proposed solutions to flood control and/or hazardous liquid spill containment.

OBJECTS AND ADVANTAGES

Accordingly I claim the following as my objects and advantages of the invention: to provide a device that is easily transported, placed and filled to form a stable, waterproof barrier against flood waters and other fluids of hazardous or nonhazardous nature. Its installation shall be easily achieved with less time and effort than other devices or proposed devices.

In addition I claim the following objects and advantages: to provide a flood control or hazardous liquid spill containment device that is easily prepared for storage and takes up a minimum of space when not in use.

Readers will find further objects and advantages of the invention from a consideration of the ensuing description and the accompanying drawings.

DRAWING FIGURES

DRAWING REFERENCE NUMERALS

Figure 1:
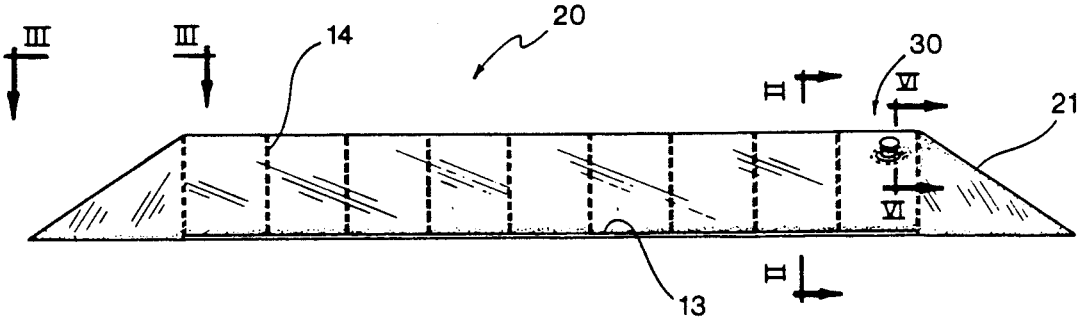
FIG. 1 shows a front elevational view of the preferred embodiment according to the invention.

11 flexible tube
12 arcuate cutouts in gussets
13 skirt
14 gussets
15 throat of fill spout
16 cap for fill spout
17 flange of fill spout
20 flood control/containment device
21 conical ends
25 air cavity on fill spout
30 fill spout
37 wide skirt
40 embodiment using wide skirt
45 floating pump assembly

DESCRIPTION

Figure 2:
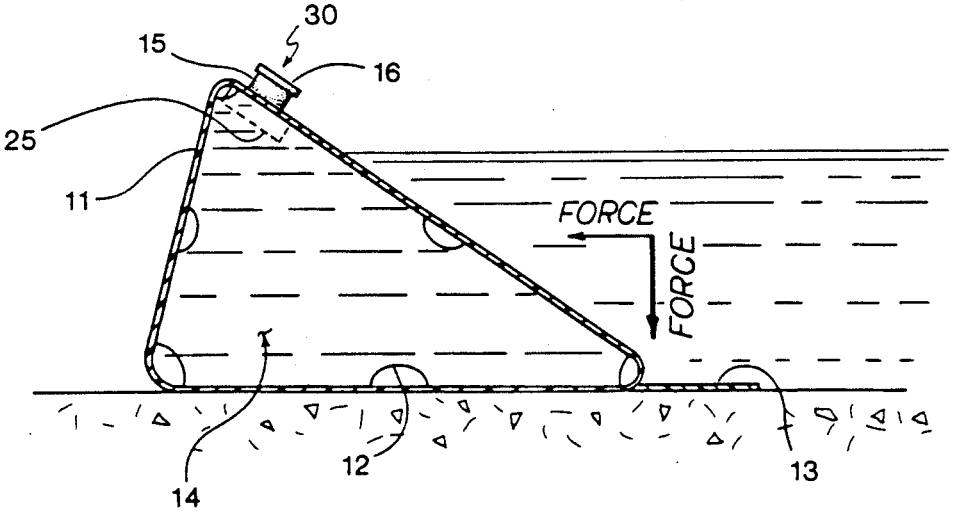
FIG. 2 is a sectional view taken along the lines of 2—2 in FIG. 1.

FIG. 2 shows a sectional view of the flood water and hazardous waste containment device 20 according to the preferred embodiment of the invention. The device 20 comprises an elongated, flexible tube 11 in the shape of an oblique angled triangle. The length of the tube 11 can fit user needs and be conveniently manufactured up to about 100 feet in length. The triangular shape is maintained by gussets 14 of flexible material, probably low density polyethylene plastic, attached by welding or adhesion to the inside of the tube 11. Arcuate cutouts 12 are placed at regular intervals along the inner circumference of the tube 11. These gussets 14 are placed at intervals of about 10 inches along the longitudinal axis of the tube 11. At the bottom front (side toward the floodwater) of the tube 11 is attached along its length a skirt 13 about 4 to 6 inches wide.

The tube 11, gussets 14, and skirt 13 are all made of a flexible, chemical resistant material—probably low density polyethylene plastic about 6 to 12 mils thick. They will be attached to each other by normal means—heat, radio frequency or ultrasonic welding or by adhesion.

Figure 3:
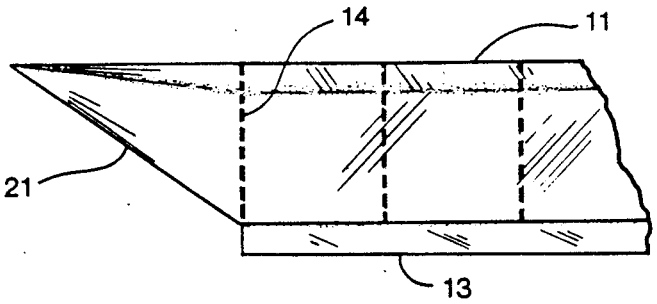
FIG. 3 is a top view of one end of the device taken along the lines of 3-3 in FIG. 1.

As shown in FIG. 1 and FIG. 3 a conical shaped end piece 21 is attached to each end of the tube 11. At one end of the device 20, as shown in FIGS. 1 and 2, is a fill spout 30. Detailed by the sectional view taken along the lines 6—6 in FIG. 1, it shows the fill spout 30 to be made up of a cylindrical throat 15 with a flange 17 at its base that attaches to the tube 11. Below the flange 17 extends a donut shaped air cavity 25. On top of the throat 15 is a cap 16 that snaps onto the upper edge of the throat 15.

Operation

The flood control and hazardous liquid containment device 20 is placed on the ground where needed with the front flap 13 towards the expected rise in water or other liquid. Heavy objects, such as rocks, may be placed on the flap 13 to stabilize the device 20 in high wind before the device 20 is filled. Also, stakes may be driven through the flap 13 and into the ground to stabilize the device 20 if flood waters are expected to be particularly forceful or swiftly flowing against the device 20.

The cap 16 is removed and a hose or tube is introduced into the throat 15 of the fill spout 30. The device 20 is allowed to fill until water is coming out the fill spout 30 and the cap 16 is replaced. The donut shaped air cavity 25 floats the fill spout 30 up as the device 20 is filled. Therefore, the device 20 can be unattended during the filling process. When the device 20 is full, the cap 16 is put back on the throat 15 of the fill spout 30.

When full, the device assumes the shape of an oblique angled triangle as shown in FIG. 2. The longest side of the triangle is that touching the flood water. The second longest side rests on the ground and the shortest side forms the rear of the device 20. This geometrical configuration is determined by the flexible gussets 14. This shape allows the flood water to exert more force down on the device than is exerted laterally, thus tending to hold the containment device 20 in place. This downward force also helps seal the device 20 against the surface upon which it is resting and, therefore, no extraneous sealing material is needed at the bottom of the device 20.

The conical ends 21 of the device 20 are shaped so that they may be easily nanipulated to form a seal against other objects or against the end of another device 20. When the emergency is over, the cap 16 is removed and the device 20 is pulled over on that end to allow water to drain out. The arcuate cutouts 12 on the gussets 14 allow water to drain freely from the device 20. After draining, the device may be rolled up for convenient storage.

Figure 4:
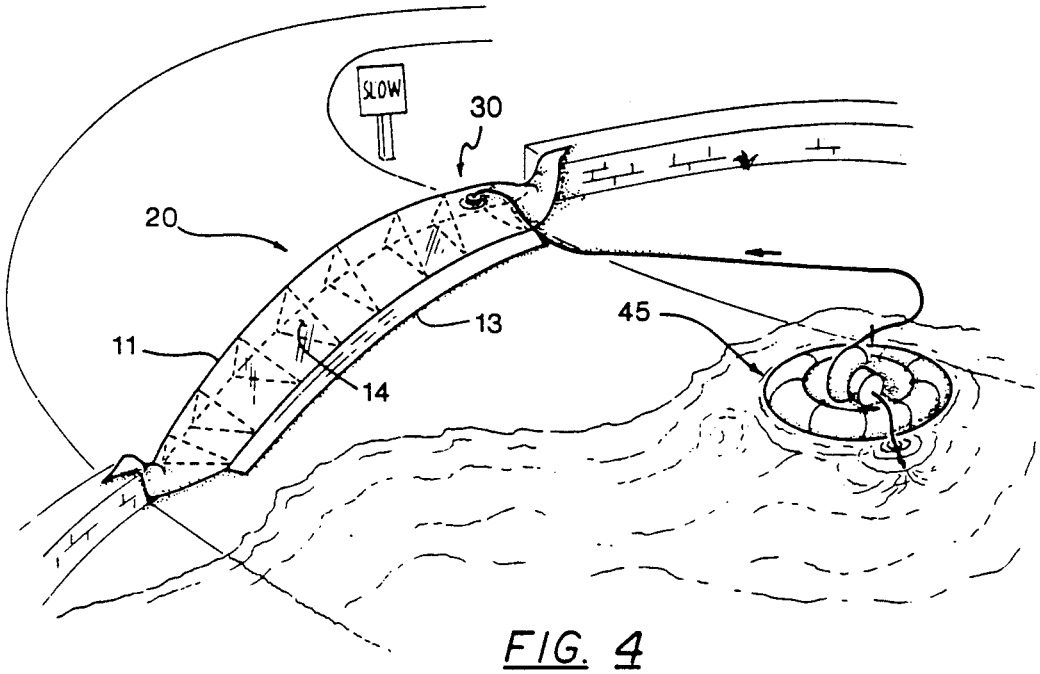
FIG. 4 is an elevational perspective view of the device in use in conjection with an on-site pump.
Figure 5:
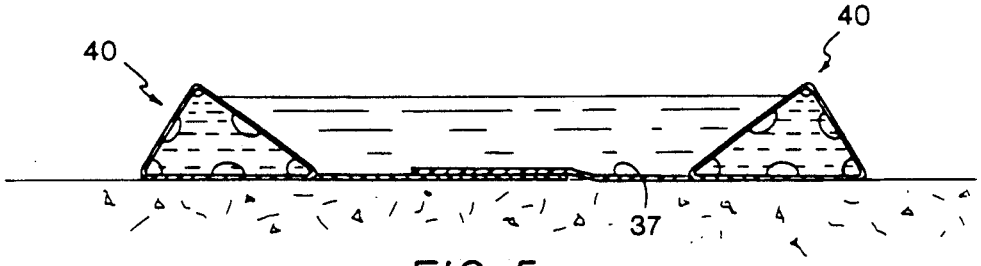
FIG. 5 is a sectional view of two devices in another embodiment.
Figure 6:
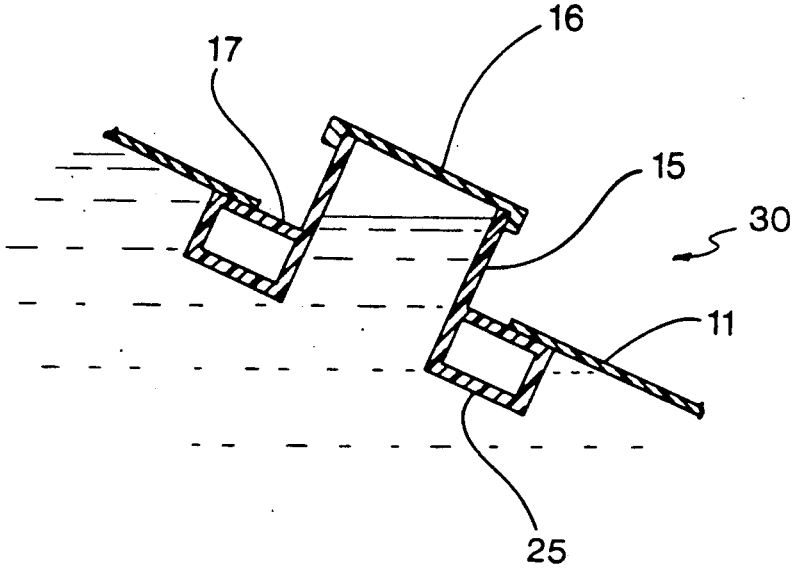
FIG. 6 is a sectional view along the lines 6—6 in FIG. 1.

Another embodiment 40 is shown in FIG. 5. In this device 40 the flap 37 is extended laterally from the device 40 and overlaps the flap 37 of a similar device 40 to form the bottom of a temporary canal or channel through which liquid may pass. These devices 40 could have applications in irrigation and emergency water supply as well as flood control Also, as shown in FIG. 4, the flood water itself can be used to fill the device 20, making its use independent of municipally supplied water. A floating pump assembly 45 is shown assisting in this process. Devices 20 or 40 might be arranged singularly or in multiples to form closed geometric shapes for storage or holding pools for water or other liquids.

Thus the reader will see that the containment device 20 of the invention provides a conveniently deployable, easily stored method of flood water control hazardous liquid containment that forms its own leak proof seal without extreneous joint packing material. The device 20 is inherently stable due to the geometric configuration of its cross section. The device 20 is easily filled, easily drained, and may be deployed by one person with very little lifting or stooping required.

While the above description contains many specific details, they should not be construed as limitations on the scope of the invention, but as exemplifications of preferred embodiments thereof. Accordingly, the reader is requested to determine the scope of the invention by the appended claims and their legal equivalents and not by the examples which have been given.

I claim:

1. A temporary dam for restraining flood waters or containing spilled liquids comprising in combination:

an elongated, closed end flexible container having three sides connected to each other thereby forming a triangular cross-section, gusset means, connected internally to each of said sides and to at least one apex of said triangle, for flexibly and internally maintaining a generally triangular cross section in said container, means for introducing fluid into said container, means for anchoring said container before or during introduction of said fluid, and means for sealing the ends of said container against irregular objects or another said container.

2. The dam as set forth in claim 1 wherein said container, said means for maintaining a triangular cross section, and said gusset means for anchoring said container comprise a man-made material or composite of man made materials.

3. The dam as set forth in claim 2 wherein said gusset means for maintaining said triangular cross section are spaced approximately 10 inches apart along the longitudinal axis of said container.

4. The dam as set forth in claim 3 wherein said means for introducing water comprises a cylindrical fill spout attached to a float, said float also being an attachment flange to said container, mounted toward the top of said container.

5. The dam as set forth in claim 4 wherein said triangular cross section causes flood water to exert more force down onto said container than laterally against said container.

6. The dam as set forth in claim 5 wherein said means for sealing the ends of said container against irregular objects comprise a cone shaped extension of said container and forming said closed ends of said container.

7. The dam as set forth in claim 6 wherein said means for anchoring said container comprises a strip of flexible, man-made material approximately 4 inches to 6 inches wide attached by normal means on one side longitudinally to the base of said container on the flood water side of said container.

8. The dam as set forth in claim 7 wherein said strip of flexible, man-made material is several feet wide.

* * * * *